US010629365B2

(12) United States Patent
Sim et al.

(10) Patent No.: US 10,629,365 B2
(45) Date of Patent: Apr. 21, 2020

(54) INDUCTOR ARRAY COMPONENT AND BOARD FOR MOUNTING THE SAME

(71) Applicant: SAMSUNG ELECTRO-MECHANICS CO., LTD., Suwon-si, Gyeonggi-do (KR)

(72) Inventors: Won Chul Sim, Suwon-si (KR); Dong Hwan Lee, Suwon-si (KR); Sang Jin Park, Suwon-si (KR); Chan Yoon, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/484,209

(22) Filed: Apr. 11, 2017

(65) Prior Publication Data

US 2018/0061561 A1 Mar. 1, 2018

(30) Foreign Application Priority Data

Aug. 26, 2016 (KR) ..... 10-2016-0108988

(51) Int. Cl.

| | |
|---|---|
| ***H01F 38/30*** | (2006.01) |
| ***H01F 27/36*** | (2006.01) |
| ***H01F 27/29*** | (2006.01) |
| ***H01F 17/04*** | (2006.01) |
| ***H01F 27/34*** | (2006.01) |
| *H01F 17/00* | (2006.01) |

(52) U.S. Cl.
CPC ..... *H01F 27/365* (2013.01); *H01F 17/04* (2013.01); *H01F 27/292* (2013.01); *H01F 27/346* (2013.01); *H01F 17/0013* (2013.01)

(58) Field of Classification Search
CPC combination set(s) only.
See application file for complete search history.

(56) References Cited

U.S. PATENT DOCUMENTS

2007/0182519 A1* 8/2007 Tsuzuki ..... H01F 17/0006 336/200
2016/0078997 A1 3/2016 Son et al.

FOREIGN PATENT DOCUMENTS

| | | | |
|---|---|---|---|
| JP | 11-144958 | A | 5/1999 |
| JP | 2005-175216 | A | 6/2005 |
| KR | 10-2013-0046108 | A | 5/2013 |
| KR | 10-2015-0031954 | A | 3/2015 |
| KR | 10-2016-0032581 | A | 3/2016 |

* cited by examiner

*Primary Examiner* — Elvin G Enad
*Assistant Examiner* — Kazi S Hossain
(74) *Attorney, Agent, or Firm* — Morgan, Lewis & Bockius LLP

(57) ABSTRACT

An inductor array component includes a body including a plurality of coil portions a coil included in the coil portions, external electrodes connected to both end portions of the coil and disposed on an outer surface of the body, a first blocking layer disposed between the coil portions, and a second blocking layer disposed within the first blocking layer.

18 Claims, 8 Drawing Sheets

INDUCTOR ARRAY COMPONENT AND BOARD FOR MOUNTING THE SAME

CROSS-REFERENCE TO RELATED APPLICATION(S)

This application claims benefit of priority to Korean Patent Application No. 10-2016-0108988, filed on Aug. 26, 2016 in the Korean Intellectual Property Office, the disclosure of which is incorporated herein by reference in its entirety.

TECHNICAL FIELD

The present disclosure relates to an inductor array component and a board for mounting the same.

BACKGROUND

An inductor, which is a multilayer electronic element, is a representative passive element that configures an electronic circuit, together with a resistor and a capacitor, to remove noise.

A multilayer type of inductor may be manufactured by printing conductive patterns on a magnetic body or a dielectric body to form coils, and then stacking the magnetic body or the dielectric body.

The multilayer type of inductor has a structure in which a plurality of magnetic layers on which the conductive patterns are formed are stacked, and internal conductive patterns in the multilayer type of inductor are sequentially connected to each other by via electrodes formed on the respective magnetic layers to form a coil structure of the inductor and, consequently, implement desired inductance and impedance characteristics.

In addition, in accordance with a recent trend of electronic devices toward slimness and lightness, demand for simplification of a power inductor structure has been increased.

In particular, demand by users for inductor which may be miniaturized, while providing excellent performance, has increased.

Meanwhile, since the inductor has recently been widely used in a multiphase mode, or the like, an application of the inductor in a form of an array has a great advantage in decreasing the number of required mounting times, as well as in decreasing a required mounting area.

However, since the form of the array has a coupling problem in the same inductor, a solution for the problem is required.

SUMMARY

An aspect of the present disclosure may provide an inductor array component which is decoupled from each other without a mutual inductance effect.

According to an aspect of the present disclosure, an inductor array component may include a body including a plurality of coil portions; a coil included in the coil portions; external electrodes connected to both end portions of the coil and disposed on an outer surface of the body; a first blocking layer disposed between the coil portions; and a second blocking layer disposed within the first blocking layer.

According to another aspect of the present disclosure, a board for mounting an inductor array component may include a substrate having a plurality of terminal electrodes disposed on at least one surface thereof; and one or more inductor array components disposed on the terminal electrodes, wherein the inductor array components include: a body including a plurality of coil portions; a coil included in the coil portions; external electrodes connected to both end portions of the coil and disposed on an outer surface of the body; a first blocking layer disposed between the coil portions; and a second blocking layer disposed within the first blocking layer.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
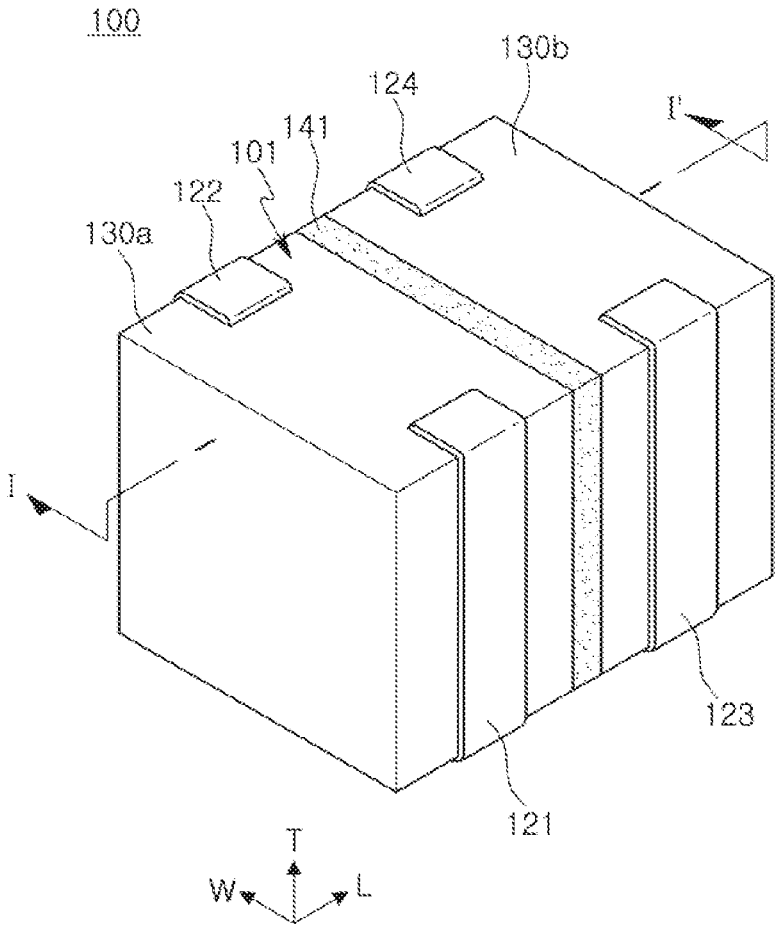
FIG. 1 schematically illustrates a perspective view of an inductor array component according to an exemplary embodiment in the present disclosure.

Hereinafter, exemplary embodiments of the present disclosure will be described in detail with reference to the accompanying drawings.

Directions of a hexahedron will be defined in order to clearly describe exemplary embodiments in the present disclosure. L shown in the drawings refers to a length direction or a first direction, W refers to a width direction or a second direction, and T refers to a thickness direction or a third direction.

The inductor array component according to an exemplary embodiment in the present disclosure may be appropriately used as a chip inductor, a power inductor, a chip beads, a chip filter, or the like in which conductive patterns are formed on magnetic layers.

Hereinafter, exemplary embodiments in the present disclosure will be described in detail with reference to the accompanying drawings.

Figure 2:
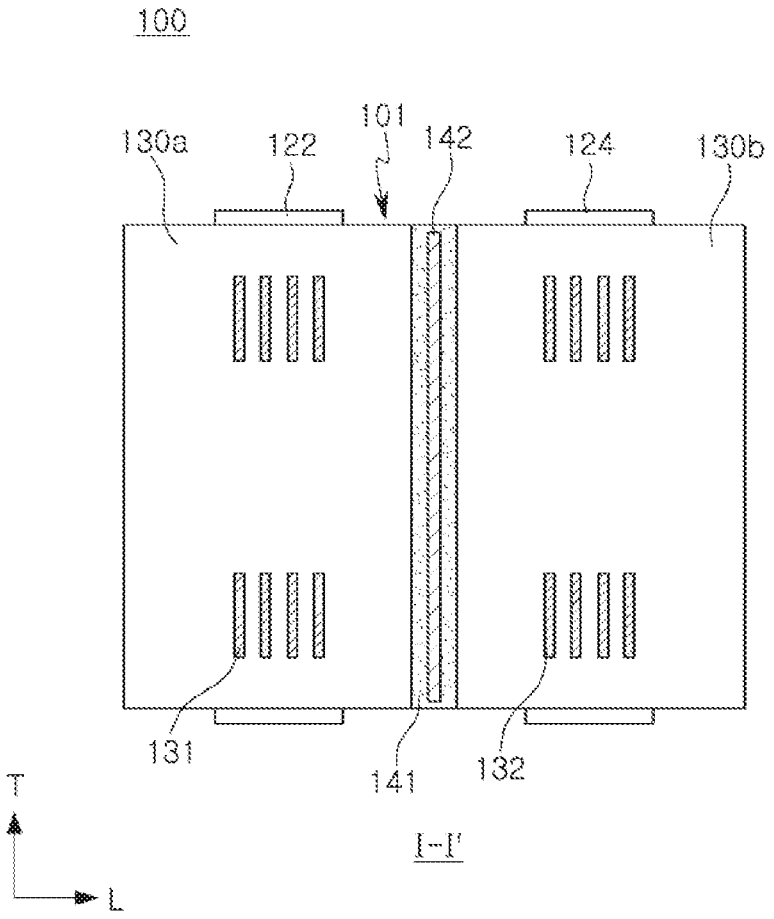
FIG. 2 illustrates a cross-sectional view taken along a line I-I' of FIG. 1.

FIG. 1 schematically illustrates a perspective view of an inductor array component according to an exemplary embodiment in the present disclosure and FIG. 2 illustrates a cross-sectional view taken along a line I-I' of FIG. 1.

Referring to FIG. 1, an inductor array component 100 according to an exemplary embodiment in the present disclosure may include a body 101 and external electrodes 121, 122, 123, and 124 disposed on an outer surface of the body 101.

The body 101 may be formed by stacking a plurality of magnetic layers. For example, the body 101 may be formed by stacking and compressing the plurality of magnetic layers in a length direction L.

The body 101 may be a hexahedron having first and second surfaces opposing each other in both end surfaces in a thickness direction of the body 101, third and fourth surfaces opposing each other in both end surfaces in a length direction of the body 101, and fifth and sixth surfaces opposing each other in both end surfaces in a width direction of the body 101, but is not limited thereto.

The first surface or the second surface of the body 101 may be provided as a mounting surface when the inductor array component 100 is mounted on a mounting board.

In addition, when the first surface or the second surface is the mounting surface, the third surface to the sixth surface may be defined as a circumferential surface of the body 101.

The body 101 may include first and second coil portions 130*a* and 130*b*, and first and second blocking layers 141 and 142 disposed between the first and second coil portions 130*a* and 130*b*.

For example, the first and second coil portions 130*a* and 130*b* may be disposed in the length direction of the body 101, and may be separated from each other by the first and second blocking layers 141 and 142 disposed therebetween.

The body 101 may be formed by stacking a plurality of magnetic layers.

For example, some of the plurality of magnetic layers may be formed of only the magnetic layers on which the conductive patterns are not formed, to serve as a cover layer, and the remaining magnetic layers may be formed of the magnetic layers on which spiral conductive patterns are formed.

The conductive patterns may be connected to each other through conductive vias to form coils 131 and 132 which are wound around the superimposed position.

The inductor array component 100 according to an exemplary embodiment may include a plurality of coils 131 and 132 in the body 101. For example, the plurality of coils 131 and 132 may be disposed to be perpendicular to the mounting surface of the body 101. That is, the spiral conductive patterns of each coil may be stacked on each other along an axis parallel to the mounting surface.

For example, a first coil 131 may be disposed on the first coil portion 130*a*, and a second coil 132 may be disposed on the second coil portion 130*b*.

The first and second coils 131 and 132 refer to separate coils which are electrically insulated from each other in the body 101.

Both end portions of the first coil 131 may be connected to first and second external electrodes 121 and 122, respectively, and both end portions of the second coil 132 may be connected to third and fourth external electrodes 123 and 124, respectively.

Accordingly, the first and third external electrodes 121 and 123 may serve as an input terminal, and the second and fourth external electrodes 122 and 124 may serve as an output terminal.

The magnetic layers used to form the body 101 may be formed of a ferrite or a metallic based soft magnetic material, but is not necessarily limited thereto.

The ferrite may include a ferrite known in the art such as a Mn—Zn based ferrite, a Ni—Zn based ferrite, a Ni—Zn—Cu based ferrite, a Mn—Mg based ferrite, a Ba based ferrite, a Li based ferrite, or the like.

The metallic based soft magnetic material may be an alloy containing any one or more selected from the group consisting of iron (Fe), silicon (Si), boron (B), chromium (Cr), aluminum (Al), and nickel (Ni). For example, the metallic based soft magnetic material may include a Fe—Si—B—Cr based amorphous metal particle, but is not necessarily limited thereto.

An average diameter of the metal particle included in the metallic based soft magnetic material may be 0.1 μm to 30 μm, and the metal particle may be dispersed on a polymer material such as an epoxy resin, a polyimide resin, or the like.

Meanwhile, the conductive patterns formed on the magnetic layers may be formed by printing a conductive paste having silver (Ag) as a main component to a predetermined thickness, or be formed by plating copper (Cu), but is not limited thereto.

The first to fourth external electrodes 121, 122, 123, and 124 may be formed on the fifth surface and the sixth surface, which are both end surfaces in the width direction of the body 101, and some of the first to fourth external electrodes may extend from the fifth surface and six surface of the body 101 to the first surface and the second surface of the body 101.

The first to fourth external electrodes 121, 122, 123, and 124 may be formed of nickel (Ni), copper (Cu), tin (Sn), or silver (Ag), or an alloy thereof, but is not limited thereto.

In addition, the first to fourth external electrodes 121, 122, 123, and 124 may be formed by applying or plating the conductive paste, but is not limited thereto.

The first and second coils 131 and 132 may have lead portions which are exposed to an outer surface of the body 101 to connect both end portions of the first and second coils 131 and 132 with the first to fourth external electrodes 121, 122, 123, and 124, respectively.

Referring to FIGS. 1 and 2, the first and second coil portions 130*a* and 130*b* may be disposed in the length direction of the body 101, and may be separated from each other by the blocking layers 141 and 142 disposed therebetween.

In the inductor array component 100 according to an exemplary embodiment, the first coil portion 130*a* may configure a first inductor and the second coil portion 130*b* may configure a second inductor. The first coil portion 130*a* and the second coil portion 130*b* may have a symmetrical shape in relation to the blocking layers 141 and 142 included in the body 101.

The central cores of the first and second coil portion 130*a* and 130*b* may be positioned at the same position as each other when being viewed from a surface perpendicular to a winding direction of the coil, but are not necessarily limited thereto.

The cores of the first and second coil portions 130*a* and 130*b* may refer to the magnetic layers positioned inside of the first and second coils 131 and 132, and the core may also be formed of a separate material, as needed.

In general, in a case in which a plurality of inductors are disposed or positioned to be adjacent to each other, inductance capacity may be changed by a mutual coupling effect between the adjacent inductors.

In order to prevent the mutual coupling effect, the plurality of inductors may be mounted so as not to be parallel to each other by disposing the plurality of inductors so as not to be adjacent to each other, or disposing one or both of the adjacent inductors so as to rotate by 90°. However, the restriction of the mounting conditions may restrict miniaturization and thinness of an electronic component.

In particular, since the inductor array component including the plurality of inductors in a single electronic component has the respective coils that are inevitably disposed to be adjacent to each other, the change of the inductance capacity due to the mutual coupling effect may be further increased.

However, since the inductor array component 100 according to an exemplary embodiment has the blocking layers 141 and 142 disposed between the first and second coil portions 130*a* and 130*b*, it may reduce a coupling factor K between the plurality of coil portions.

The blocking layers may include a first blocking layer 141 and a second blocking layer 142. The first blocking layer 141 and the second blocking layer 142 may be formed of different materials, and may also be formed of a material different from the body 101.

Referring to FIG. 2, the second blocking layer 142 may be disposed within the first blocking layer 141.

For example, the first and second blocking layers 141 and 142 may be alternately disposed to have a sandwich shape, and the second blocking layer 142 may be positioned at the center and the first blocking layer 141 may be disposed on both sides of the second blocking layer 142.

In addition, the first blocking layer 141 may also be disposed to wrap around the second blocking layer 142.

The number of the first and second blocking layers 141 and 142 may be at least one or more.

The first blocking layer 141 may be formed of a material, such as a dielectric, having permeability lower than that of the body 101, and in the case in which the first blocking layer 141 may be formed of the material, such as a dielectric, having permeability lower than that of the body 101, the second blocking layer 142 may be formed of a ferromagnetic material.

Unlike this, the first blocking layer 141 may be formed of the ferromagnetic material, and in the case in which the first blocking layer 141 may be formed of the ferromagnetic material, the second blocking layer 142 may be formed of a material, such as a dielectric, having permeability lower than that of the body 101.

The material having permeability lower than that of the body 101 may be a Zn-ferrite based non-magnetic material having low permeability, but is not limited thereto.

The dielectric may refer to a dielectric including any one or more of $SiO_2$, $Al_2O_3$, $TiO_2$, and $ZrO_2$, but is not limited thereto.

The ferromagnetic material may be a metallic ferrite such as nickel (Ni), iron (Fe), cobalt (Co), permalloy, or the like.

In the case in which the first blocking layer 141 or the second blocking layer 142 is formed of the material, such as, a dielectric, having permeability lower than that of the body 101, the first blocking layer 141 or the second blocking layer 142 formed of the material, such as a dielectric, having permeability lower than that of the body 101 may serve to block a magnetic field occurring from the first and second coil portions 130*a* and 130*b*.

Thicknesses of the blocking layers 141 and 142 may be 10 to 100 μm. The thicknesses of the blocking layers 141 and 142 refer to a distance between the plurality of coil portions 130*a* and 130*b*.

The following Table 1 illustrates coupling factors measured according to the thicknesses of the blocking layers 141 and 142 of a case (comparative example) in which all of the first and second blocking layers 141 and 142 are the magnetic material and a case (example 1) in which all of the first and second blocking layers are the dielectric.

TABLE 1

| Thickness of Blocking Layer (μm) | Coupling Factor (%) Example 1 (μ = 1) | Coupling Factor (%) Comparative Example (μ = 20) |
|---|---|---|
| 10 | 4.4 | 5.9 |
| 20 | 3.6 | 5.5 |
| 30 | 3.1 | 5.1 |
| 40 | 2.7 | 4.7 |
| 50 | 2.5 | 4.4 |
| 100 | 1.7 | 3.1 |

As illustrated in Table 1, it may be seen that the coupling factor of the case in which the dielectric is disposed between the plurality of coil portions 130*a* and 130*b* is lower than that of the case in which the magnetic material is disposed between the plurality of coil portions 130*a* and 130*b*, and as the thickness of the blocking layer is increased, the coupling factor is decreased.

However, when only the dielectric is used as the blocking layers 141 and 142, there is a problem that magnetic flux leakage still occurs through the blocking layers.

Figure 3A:
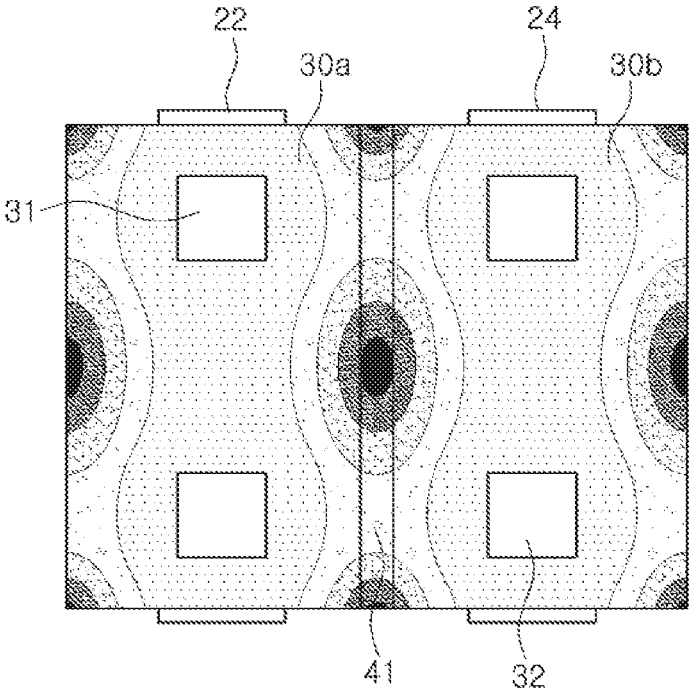
FIG. 3A illustrates measured inductance of an inductor array component according to a comparative example and FIG. 3B schematically illustrates internal magnetic flux density of the inductor array component according to the comparative example.
Figure 3B:
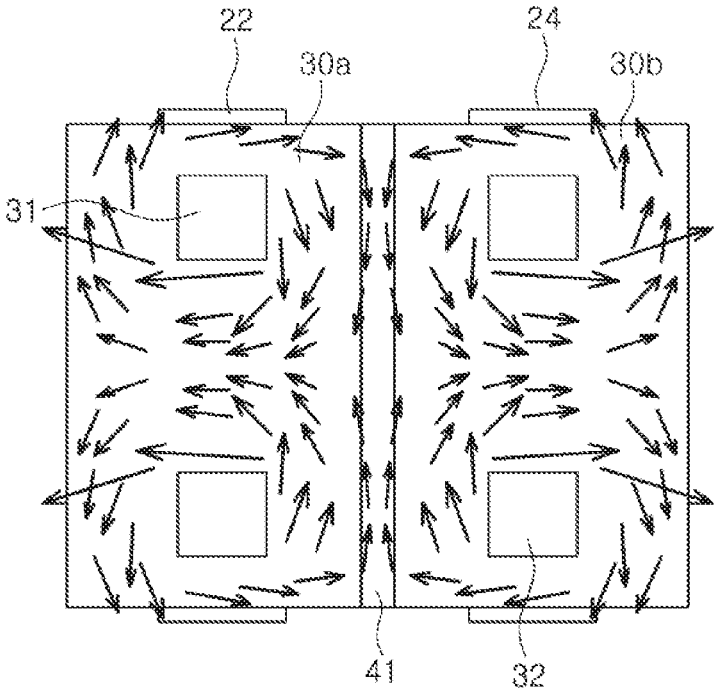

FIG. 3A illustrates measured inductance of an inductor array component according to a comparative example and FIG. 3B schematically illustrates internal magnetic flux density of the inductor array component according to the comparative example.

Referring to FIGS. 3A and 3B, in a case in which a blocking layer 41 is a magnetic material, the respective coils 31 and 32 may be affected by each other by magnetic fluxes having different directions formed in the respective coils 31 and 32. In this case, the coupling factor of the comparative example may be 6.4%.

That is, in a case in which a current flows in the two coils 31 and 32, the two coils 31 and 32 may have a value lower than inductance of the respective coil portions 30*a* and 30*b* by 6.4%.

In the case of the comparative example, since the blocking layer 41 is formed of the same magnetic material as the body, the magnetic flux may be concentrated on a boundary surface between the coils 31 and 32 to increase mutual influence between the coils.

Figure 4A:
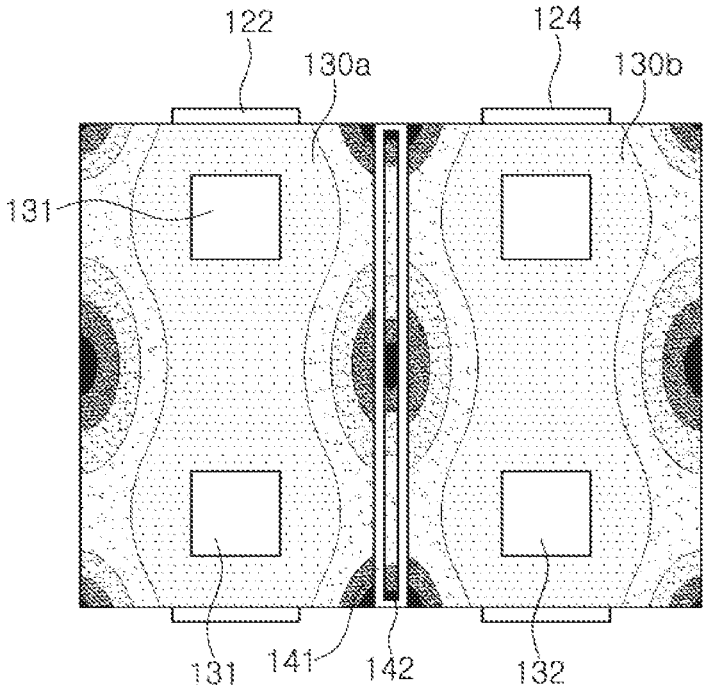
FIG. 4A illustrates measured inductance of an inductor array component according to an exemplary embodiment in the present disclosure and FIG. 4B schematically illustrates internal magnetic flux density of the inductor array component according to an exemplary embodiment in the present disclosure.
Figure 4B:
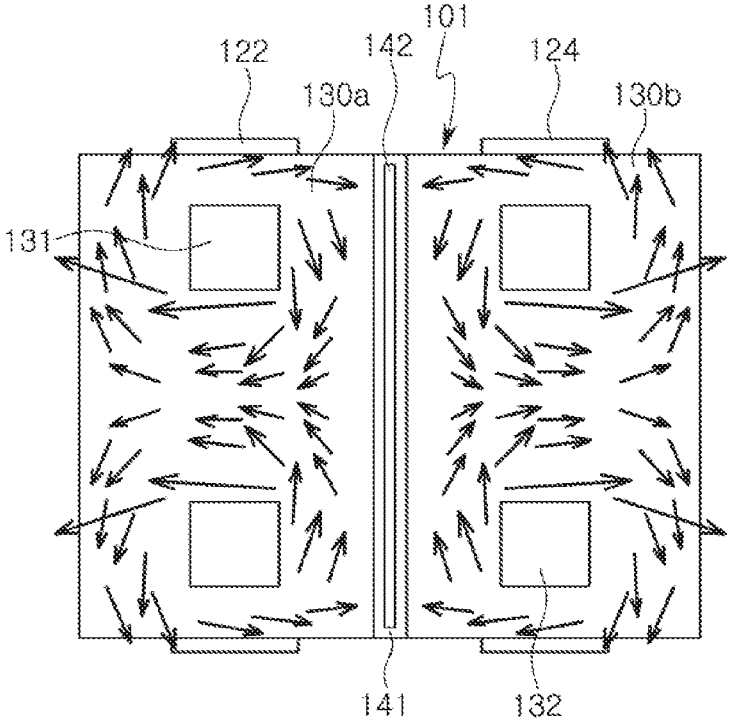

FIG. 4A illustrates measured inductance of an inductor array component according to an exemplary embodiment in the present disclosure and FIG. 4B schematically illustrates internal magnetic flux density of the inductor array component according to an exemplary embodiment in the present disclosure.

Unlike FIGS. 3A and 3B, the inductor array component 100 according to an exemplary embodiment may have the first blocking layer 141 or the second blocking layer 142 formed of the material, such as a dielectric, having permeability lower than that of the body 101 to prevent the magnetic flux from being concentrated on the boundary surface between the first and second coil portions 130*a* and 130*b*.

For example, as illustrated in FIGS. 4A and 4B, the first blocking layer 141 may be formed of the material, such as a dielectric, having low permeability, and the second blocking layer 142 may be formed of a ferromagnetic material.

As such, in the case in which the first blocking layer 141 is formed of the material, such as a dielectric, having low permeability and the second blocking layer 142 is formed of the ferromagnetic material, the coupling factor may be decreased to 1.5% from 1.7%, in relation to a case in which the thickness of the blocking layers 141 and 142 is 100 μm.

That is, in the case in which the second blocking layer 142 is the ferromagnetic material, the second blocking layer 142 may absorb the magnetic flux leaking from the first blocking layer 141 to decrease the coupling factor of the first and second coil portions 130*a* and 130*b*.

Figure 5:
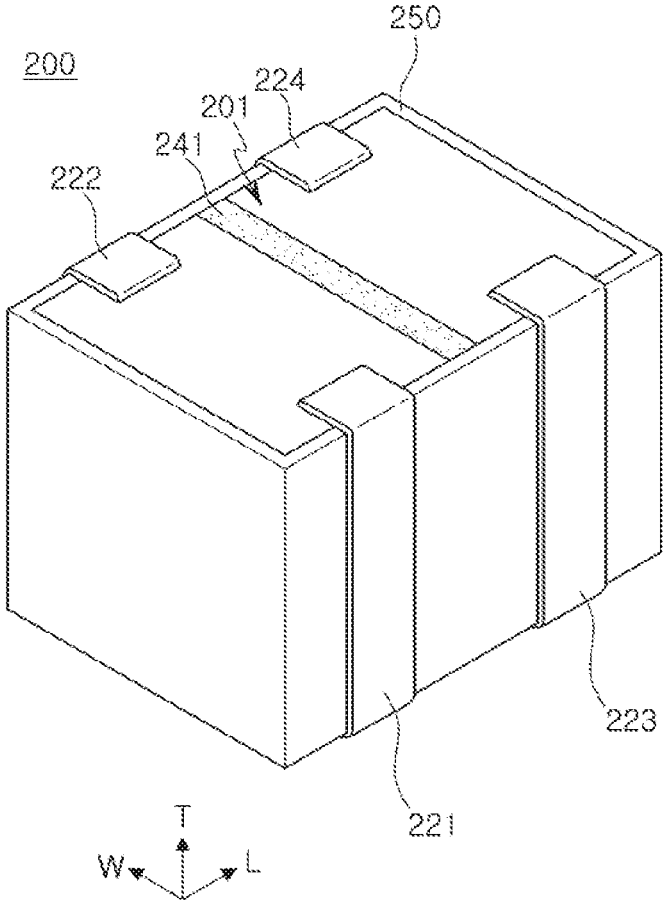
FIG. 5 schematically illustrates a perspective view of an inductor array component according to another exemplary embodiment in the present disclosure.

FIG. 5 schematically illustrates a perspective view of an inductor array component 200 according to another exemplary embodiment in the present disclosure.

Referring to FIG. 5, an inductor array component 200 according to another exemplary embodiment in the present disclosure may include a body 201, a blocking layer 241 which may include the aforementioned first and second blocking layers, and external electrodes 221, 222, 223, and 224.

In the inductor array component 200 according to another exemplary embodiment, a description of the same configuration as the inductor array component 100 according to an exemplary embodiment described above will be omitted.

The inductor array component 200 according to another exemplary embodiment may include a third blocking layer 250 disposed on at least a portion or all of the circumferential surface perpendicular to a mounting surface of the body 201. The third blocking layer 250 may not be disposed on the mounting surface and a surface opposing the mounting surface.

The third blocking layer 250 may be formed of a ferromagnetic material, and the ferromagnetic material may be a metallic ferrite such as nickel (Ni), iron (Fe), cobalt (Co), permalloy, or the like.

Since the inductor array component 200 according to another exemplary embodiment includes the third blocking layer 250 disposed on the circumferential surface perpendicular to the mounting surface, it may not be affected by a magnetic field of another inductor array component even in a case in which the inductor array component 200 is disposed to be adjacent to another inductor array component at the time of mounting the inductor array component 200.

Therefore, the inductor array component 200 according to another exemplary embodiment may have a high degree of freedom of amounting format the time of the mounting to increase mounting efficiency.

Figure 6:
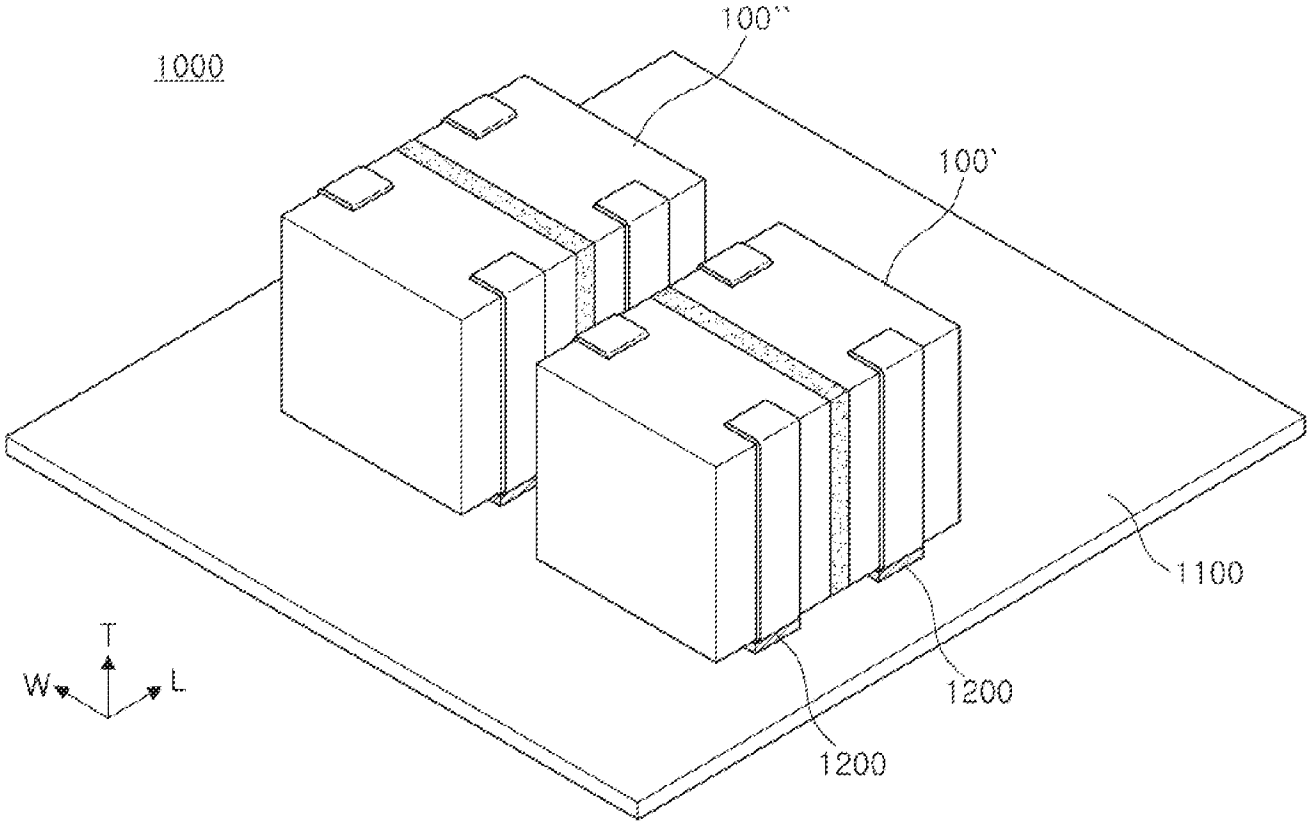
FIG. 6 schematically illustrates a perspective view of a board for mounting an inductor array component according to another exemplary embodiment in the present disclosure.

FIG. 6 schematically illustrates a perspective view of a board for mounting an inductor array component according to another exemplary embodiment in the present disclosure.

Referring to FIG. 6, a board 1000 for mounting an inductor array component according to another exemplary embodiment in the present disclosure may include a substrate 1100 having a plurality of terminal electrodes 1200 disposed on at least one surface thereof, and one or more inductor array components 100' and 100" disposed on the terminal electrodes 1200.

The inductor array components 100' and 100" may be the inductor array component 100 according to an exemplary embodiment, or the inductor array component 200 according to another exemplary embodiment.

The inductor array components 100' and 100" may be connected to the substrate 1100 by solder in a state in which external electrodes are disposed to be in contact with the plurality of terminal electrodes 1200.

In particular, in a case in which there are a plurality of inductor array components 100' and 100" as in the case in which the inductor array components 100' and 100" are a first inductor array component 100' and a second inductor array component 100", at least some of the plurality of inductor array components 100' and 100" may be disposed so that end surfaces, in a length direction of the inductor array components, are adjacent to each other.

The inductor array components 100 and 200 and the board 1000 for mounting the same according to various exemplary embodiments in the present disclosure may be designed to decrease the coupling factor by implementing two or more coils in one electronic component and reducing the influence of the two or more coils on each other as described above, and particularly, may be designed to further decrease the coupling factor by forming one of the blocking layers with the ferromagnetic material to absorb the magnetic flux leakage.

Since the inductor array component 200 according to another exemplary embodiment includes the third blocking layer 250 disposed on the circumferential surface perpendicular to the mounting surface, it may not be affected by a magnetic field of another inductor array component even in a case in which the inductor array component 200 is disposed to be adjacent to another inductor array component at the time of mounting the inductor array component 200 on the mounting substrate.

Therefore, the inductor array component 200, according to another exemplary embodiment may have a high degree of freedom of amounting format the time of the mounting, to further increase mounting efficiency.

As set forth above, according to the exemplary embodiments in the present disclosure, since the inductor array component includes the first blocking layer disposed between the coil portions and the second blocking layer, disposed on the first blocking layer, the inductor array component may be decoupled from each other without the mutual inductance effect between the coil portions.

While exemplary embodiments have been shown and described above, it will be apparent to those skilled in the art that modifications and variations could be made without departing from the scope of the present invention, as defined by the appended claims.

What is claimed is:

1. An inductor array component comprising:

a body including first and second coil portions, and having first and second surfaces opposing each other in a thickness direction of the body, third and fourth surfaces opposing each other in a length direction of the body, and fifth and sixth surfaces opposing each other in a width direction of the body;

first and third external electrodes connected to respective end portions of the first and second coil portions, disposed on the fifth surface of the body, and extending to the first surface of the body;

second and fourth external electrodes connected to respective other end portions of the first and second coil portions, disposed on the sixth surface of the body, and extending to the first surface of the body;

a first blocking layer disposed between the first and second coil portions in the length direction, and spaced apart from the first and second coil portions; and a second blocking layer disposed completely within the first blocking layer, wherein spiral conductive patterns of the first coil portion are stacked on each other in the length direction, and spiral conductive patterns of the second coil portion are stacked on each other in the length direction, the first blocking layer is formed of a ferromagnetic material, the second blocking layer is formed of a material having a permeability lower than that of a magnetic material included in the body, the material having the permeability lower than that of the magnetic material included in the body is a dielectric material, and each of the first and second coil portions is a vertical type helical coil with respect to one of the first, second, fifth, or sixth surface.

2. An inductor array component comprising:

a body including first and second coil portions, and having first and second surfaces opposing each other in a thickness direction of the body, third and fourth surfaces opposing each other in a length direction of the body, and fifth and sixth surfaces opposing each other in a width direction of the body;

first and third external electrodes connected to respective end portions of the first and second coil protons, disposed on the fifth surface of the body, and extending to the first surface of the body;

second and fourth external electrodes connected to respective other end portions of the first and second coil portions, disposed on the sixth surface of the body, and extending to the first surface of the body;

a first blocking layer disposed between the first and second coil portions in the length direction, and spaced apart from the first and second coil portions;

a second blocking layer disposed completely within the first blocking layer; and a third blocking layer disposed on a circumferential surface perpendicular to a mounting surface of the body, wherein spiral conductive patterns of the first coil portion are stacked on each other in the length direction, and spiral conductive patterns of the second coil portion are stacked on each other in the length direction, and each of the first and second coil portions is a vertical type helical coil with respect to one of the first, second, fifth, or sixth surface.

3. The inductor array component of claim 2, wherein the third blocking layer is formed of a ferromagnetic material.

4. The inductor array component of claim 1, wherein the first and second coil portions are disposed to be perpendicular to a mounting surface of the inductor array component.

5. A board for mounting an inductor array component, the board comprising:

a substrate having a plurality of terminal electrodes disposed on at least one surface thereof; and the inductor array component of claim 1 disposed on the terminal electrodes, a mounting surface of the inductor array component facing the substrate.

6. The board for mounting an inductor array component of claim 5, wherein each of the one or more inductor array components further comprises a third blocking layer disposed on a circumferential surface perpendicular to the mounting surface thereof.

7. The board for mounting an inductor array component of claim 6, wherein the third blocking layer is formed of a ferromagnetic material.

8. The board for mounting an inductor array component of claim 5, wherein the first and second coil portions are disposed to be perpendicular to the mounting surface.

9. The board for mounting an inductor array component of claim 5, wherein the inductor array components are plural, and at least some of the plurality of inductor array components are disposed so that end surfaces of the inductor array components, in the length direction of the inductor array components, are adjacent to each other.

10. An inductor array component comprising:

a body including first and second coil portions electrically isolated from each other within the body, and having first and second surfaces opposing each other in a thickness direction of the body, third and fourth surfaces opposing each other in a length direction of the body, and fifth and sixth surfaces opposing each other in a width direction of the body;

first and third external electrodes connected to respective end portions of the first and second coil portions, disposed on the fifth surface of the body, and extending to the first surface of the body;

second and fourth external electrodes connected to respective other end portions of the first and second coil portions, disposed on the sixth surface of the body, and extending to the first surface of the body;

a first blocking layer disposed between the first coil portion and the second coil portion in the length direction, and spaced apart from the first coil portion and the second coil portion; and a second blocking layer disposed completely within the first blocking layer, wherein spiral conductive patterns of the first coil portion are stacked on each other in the length direction, and spiral conductive patterns of the second coil portion are stacked on each other in the length direction, and each of the first and second coil portions is a vertical type helical coil with respect to one of the first, second, fifth, or sixth surface.

11. The inductor array component of claim 10, wherein the first blocking layer is formed of a material having a permeability lower than that of a magnetic material included in the body, and the second blocking layer is formed of a ferromagnetic material.

12. The inductor array component of claim 11, wherein the material having the permeability lower than that of the magnetic material included in the body is a dielectric material.

13. The inductor array component of claim 10, wherein the first blocking layer is formed of a ferromagnetic material, and the second blocking layer is formed of a material having a permeability lower than that of a magnetic material included in the body.

14. The inductor array component of claim 13, wherein the material having the permeability lower than that of the magnetic material included in the body is a dielectric material.

15. The inductor array component of claim 10, further comprising a third blocking layer disposed on a circumferential surface perpendicular to a mounting surface of the body.

16. The inductor array component of claim 15, wherein the third blocking layer is formed of a ferromagnetic material.

17. The inductor array component of claim 10, wherein the first and second coil portions are disposed to be perpendicular to a mounting surface of the inductor array component, and each of the first to fourth external electrodes extends from the mounting surface to a surface opposing the mounting surface.

18. A board for mounting an inductor array component, the board comprising:

a substrate having a plurality of terminal electrodes disposed on at least one surface thereof; and the inductor array component of claim 10 disposed on the terminal electrodes, a mounting surface of the inductor array component facing the substrate.

* * * * *